US006089436A

United States Patent [19]

Ho et al.

[11] Patent Number: 6,089,436

[45] Date of Patent: Jul. 18, 2000

[54] VENTILATION DEVICE OF A POWER STAPLER

[75] Inventors: Roman Ho; Jack Chen; Sunking Hung, all of Taichung, Taiwan

[73] Assignee: Basso Industry Corp., Taichung, Taiwan

[21] Appl. No.: 09/408,487

[22] Filed: Sep. 30, 1999

[51] Int. Cl.[7] ..... B25C 1/04

[52] U.S. Cl. ..... 227/130

[58] Field of Search ..... 227/130, 10, 8

[56] References Cited

U.S. PATENT DOCUMENTS

| | | | |
|---|---|---|---|
| 5,110,030 | 5/1992 | Tanji | 227/130 |
| 5,476,205 | 12/1995 | Canlas et al. | 227/130 |
| 5,706,996 | 1/1998 | Lee | 227/130 |
| 5,725,142 | 3/1998 | Hamada | 227/130 |
| 5,927,584 | 7/1999 | Akiba | 227/130 |
| 6,024,269 | 2/2000 | Ho et al. | 227/130 |

*Primary Examiner*—Scott A. Smith
*Attorney, Agent, or Firm*—Charles E Baxley, Esq.

[57] ABSTRACT

A ventilation device of a power stapler which has an end base connected to the rear end of the power stapler and a cap is rotatably mounted to the end base. The end base has a recess and a protrusion extends from a bottom of the recess. At least one aperture is defined radially through the protrusion and a boss extends from the protrusion. The cap has a skirt portion and a passage is defined radially through the cap so that the skirt portion is engaged with the recess between the protrusion and the inside defining the recess. The boss is engaged with one of the dents of the cap so that the location of the passage can be adjusted by rotating the cap.

2 Claims, 6 Drawing Sheets

VENTILATION DEVICE OF A POWER STAPLER

FIELD OF THE INVENTION

The present invention relates to a ventilation device on a rear end of a power stapler, the ventilation device having a rotatable cap having a ventilation passage and the cap is secured to a protrusion on the power stapler so that the direction of ventilating the pressured air can be controlled.

BACKGROUND OF THE INVENTION

A conventional ventilation device for a power stapler is shown in FIG. 1 and comprises a protrusion 10 extending from a rear end of a power stapler and the protrusion 10 has a notch 11 defined therethrough. The notch 11 communicates with the interior of the power stapler so that pressure air will eject from the notch 11 when shooting a staple. A circular flange 14 extends from the rear end of the power stapler and encloses the protrusion 10. A cap 13 has a passage 12 defined radially therein and a groove 15 defined in the inner periphery thereof so that the cap 13 is mounted to the rear end of the power stapler with the circular flange 14 engaged with the groove 15. Because there is no reliable positioning means to let the cap 13 secure to the circular flange 14 so that the connection of the cap 13 and the circular flange 14 could be loosened by the pressure air flow. Furthermore, the direction of the air ejected could result the wood powder raises so that the users will like to adjust the direction of the air flow so as not to blow the wood powder around the users.

The present invention intends to provide a ventilation device of a power stapler wherein the protrusion on the rear end of the power stapler has a boss extending therefrom and the cap has a plurality of dents so that the cap is positioned by receiving the boss in one of the dents when rotating an angle. Therefore, the direction of the ejection of the air flow can be adjusted.

SUMMARY OF THE INVENTION

In accordance with one aspect of the present invention, a ventilation device of a power stapler is provided and comprises an end base connected to the rear end of the power stapler and the end base has a recess defined therein. A protrusion extends from a bottom defining the recess and an annular recess is defined between the protrusion and an inside of the recess of the end base. At least one aperture is defined radially through the protrusion and a groove is defined radially in a periphery of the protrusion. A boss extends from the protrusion. A cover has a skirt portion which is engaged with the recess and a passage defined radially through the skirt portion. A plurality of dents are defined in an inside of the cover so that the boss is engaged with one of the dents when rotating the cap.

The main object of the present invention is to provide a ventilation device of a power stapler wherein the direction of the passage through which the pressurized air flows can be adjustable by rotating the cap.

Further objects, advantages, and features of the present invention will become apparent from the following detailed description with appropriate reference to the accompanying drawings.

BRIEF DESCRIPTION OF THE DRAWINGS

FIG. 2 is a perspective view of the punch in accordance with the present invention;

DETAILED DESCRIPTION OF THE PREFERRED EMBODIMENTS

Figure 1:
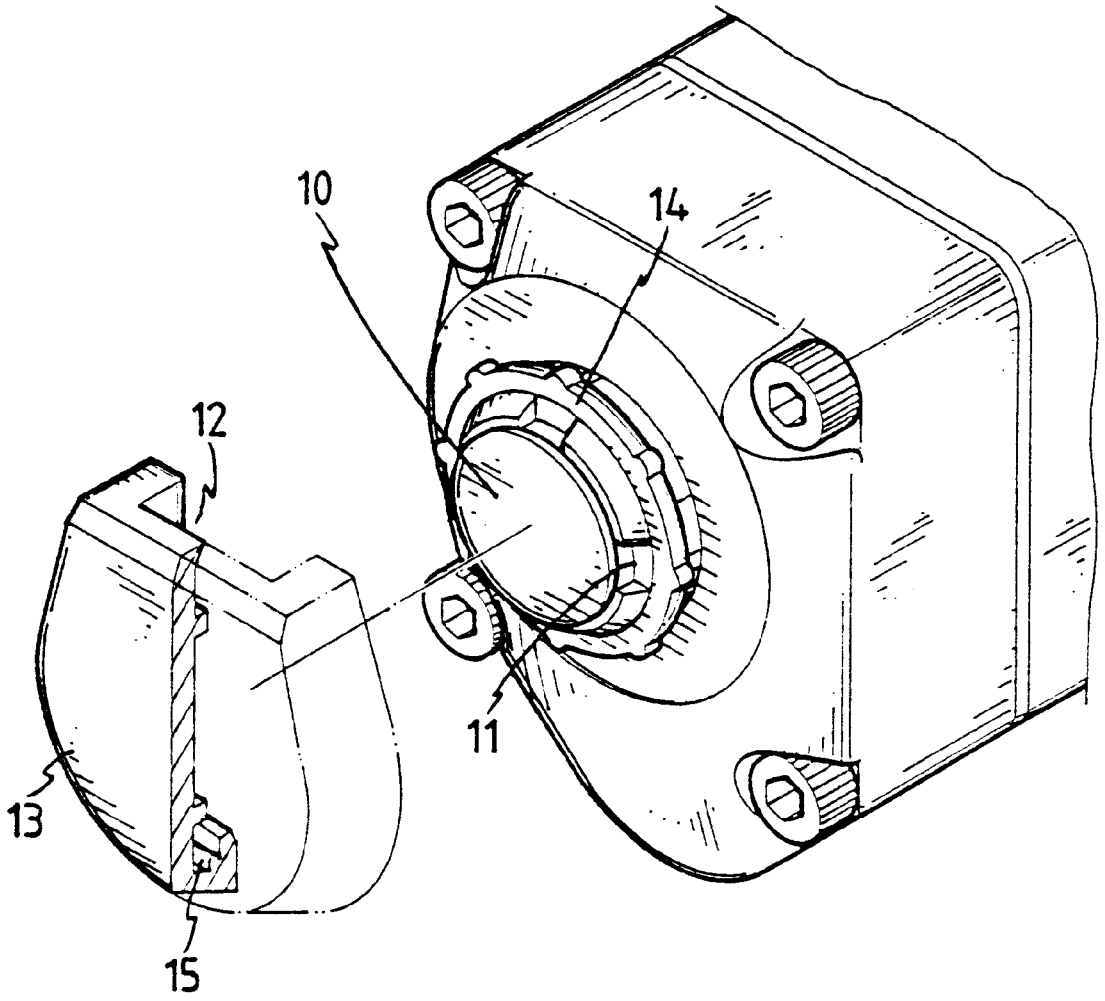
FIG. 1 PRIOR ART
FIG. 1 is an exploded view of a conventional ventilation device of a power stapler.
Figure 2:
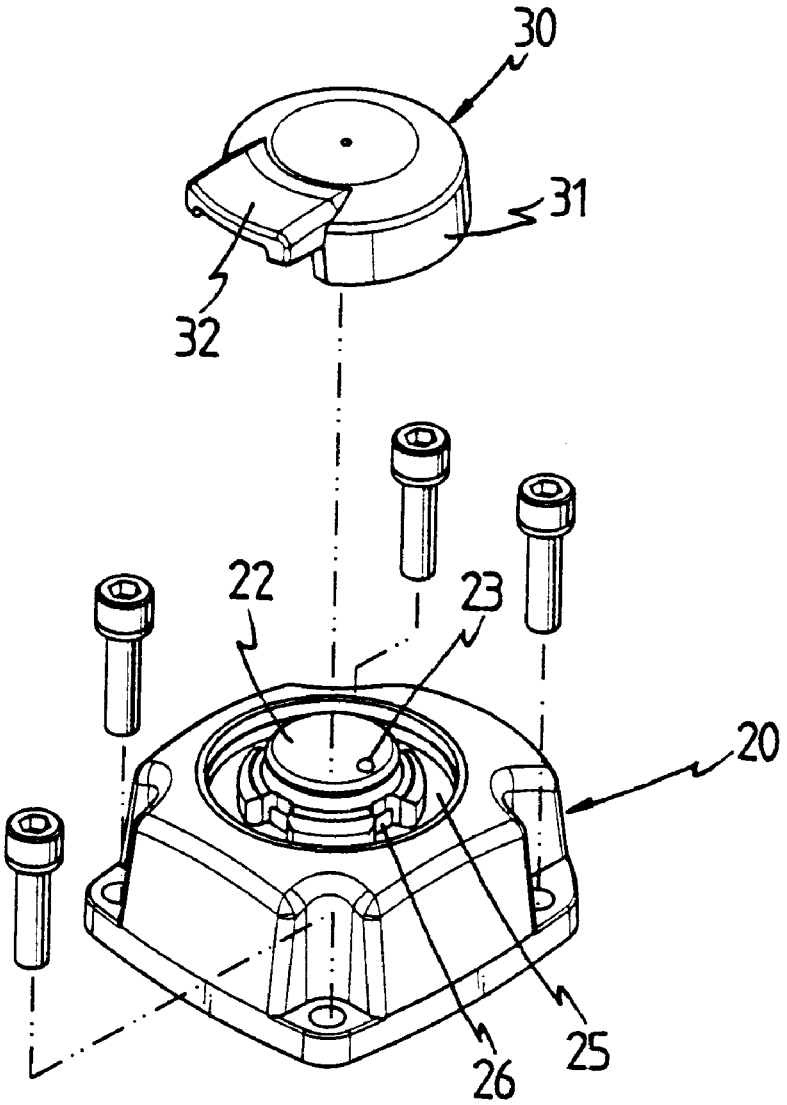
FIG. 2 is an exploded view of the ventilation device of a power stapler in accordance with the present invention.
Figure 3:
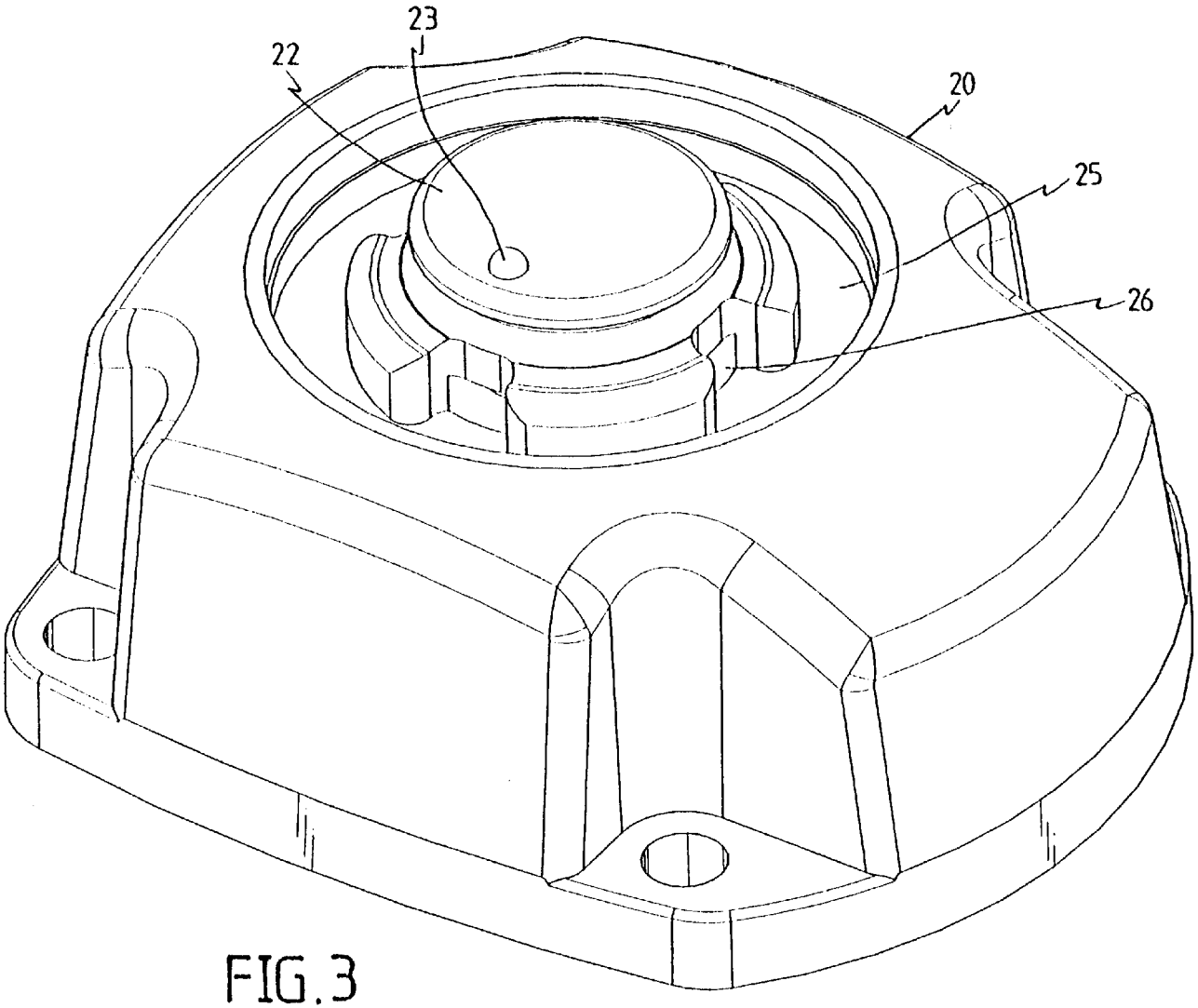
FIG. 3 is a perspective view of the end base in accordance with the present invention.
Figure 6:
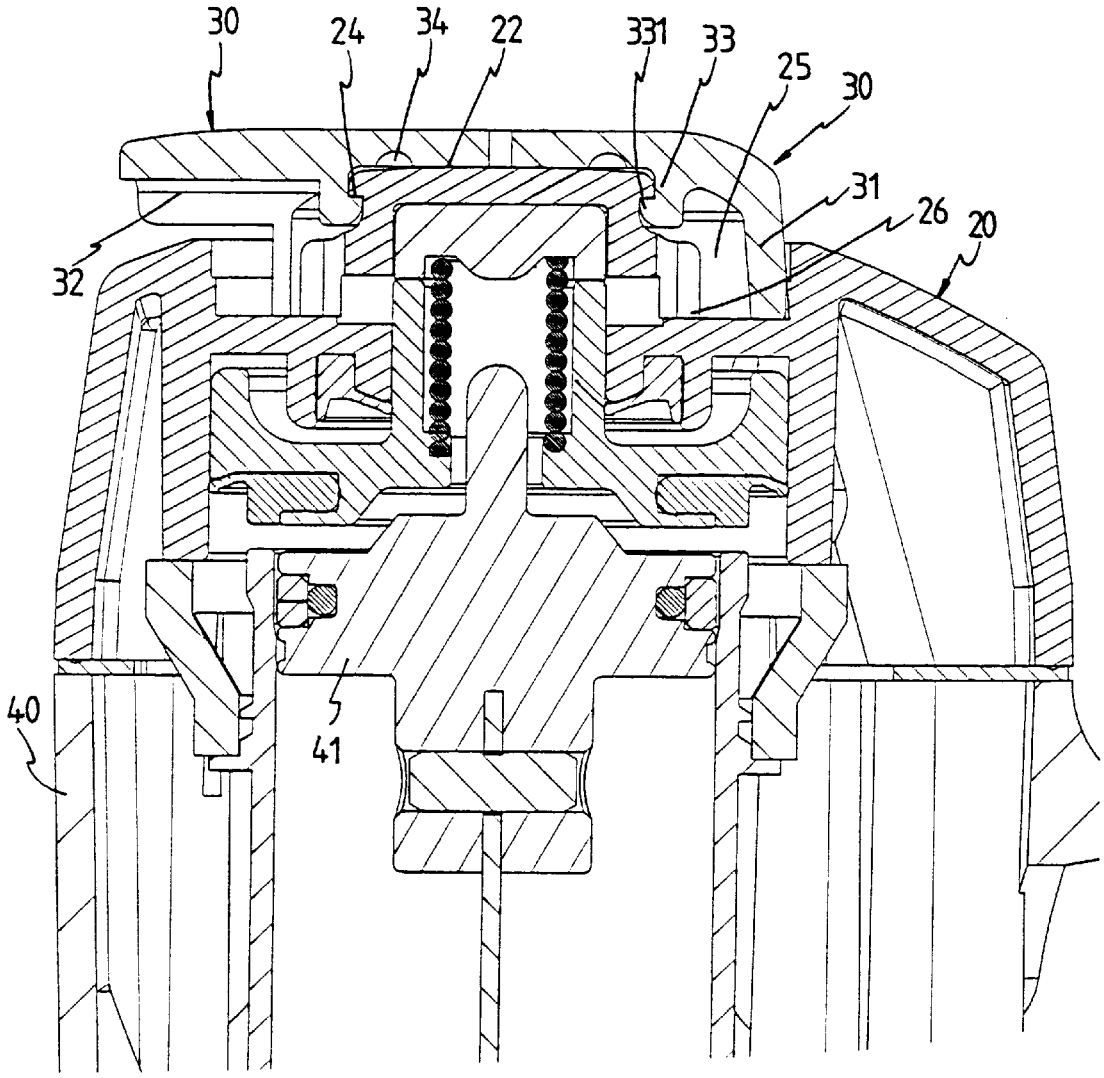

Referring to FIGS. 2 and 3, the ventilation device of a power stapler of the present invention comprises an end base 20 which is fixedly connected to the rear end of the power stapler 40 and the end base 20 has a recess defined therein, A protrusion 22 extends from a bottom defining the recess of the end base 20 so as to define an annular recess 25 between the protrusion 22 and an inside of the recess of the end base 20. Further referring to FIG. 6, a plurality of apertures 26 are defined radially through the protrusion 22 and communicate with the interior of the power stapler 40 so that the pressurized air expelled by the piston 41 will eject from the apertures 26 when shooting a staple. A groove 24 is defined radially in a periphery of the protrusion 22 and a boss 23 extends from the protrusion 22.

Figure 4:
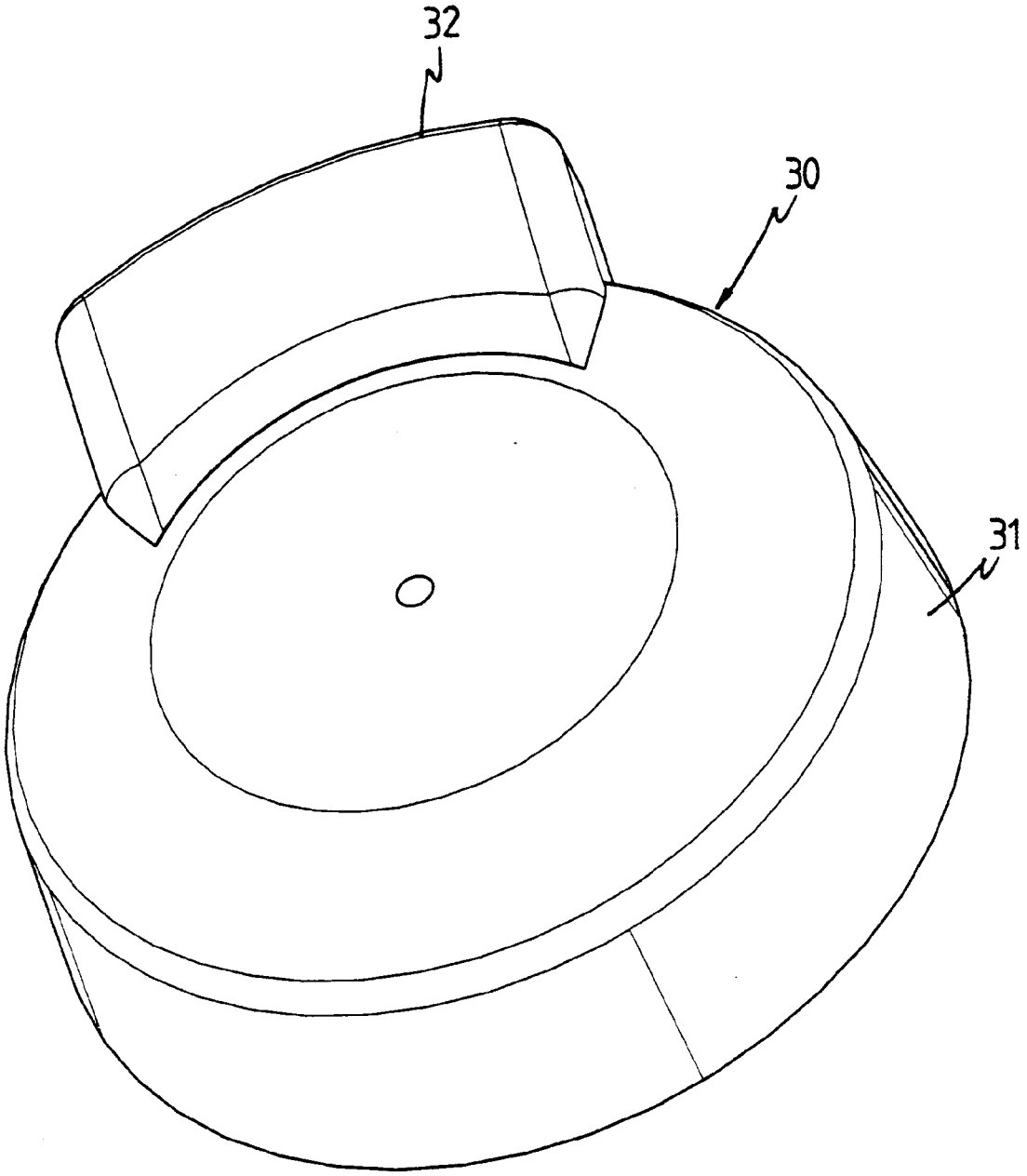
FIG. 4 is a perspective view of the cap of the ventilation device in accordance with the present invention.
Figure 5:
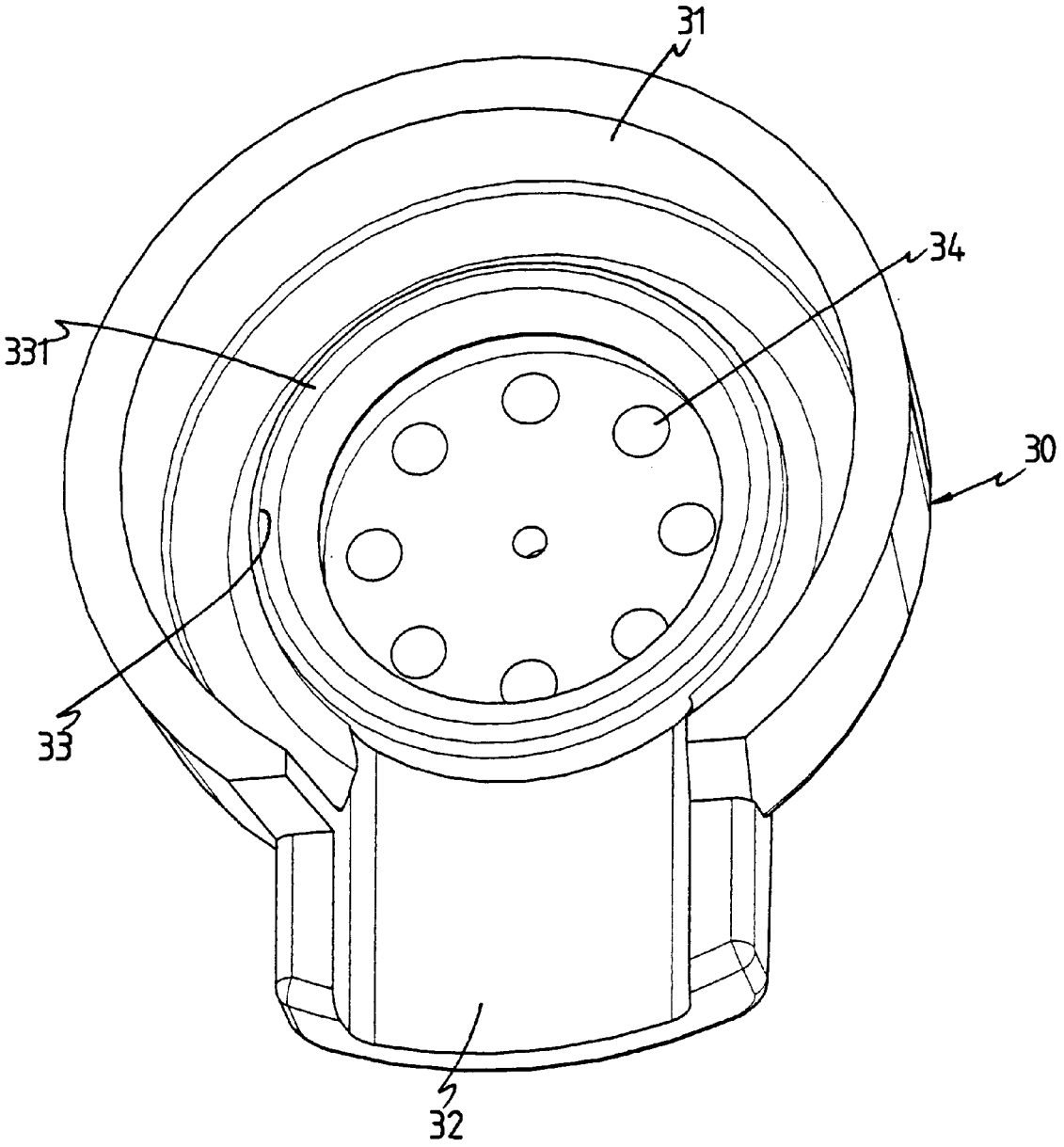
FIG. 5 is a perspective bottom view of the cap of the ventilation device in accordance with the present invention, and FIG. 6 a side elevational view, partly in section, of the ventilation device connected to the power stapler in accordance with the present invention.

Referring to FIGS. 4 and 5, a cover 30 has a skirt portion 31 extending from the periphery thereof and a passage 32 defined radially through the skirt portion 31. A plurality of dents 34 are defined in an inside of the cover 30 and a hook portion 331 extends radially inward from an inside of the skirt portion 33. The cover 30 is rotatably connected to the end base 20 with the hook portion 331 engaged with the groove 24 of the protrusion 22 and the skirt portion 331 received in the annular recess 25 and contacting against the inside of the recess of the end base 20. The boss 23 is therefore engaged with one of the dents 34 in the cover 30.

The engagement of the hook portion 331 and the groove 24 in the protrusion 22 ensure that the cover 30 will not loose when the pressurized air it the cover 30. The engagement of the boss 23 and the dents 34 provides an indexing and positioning function so that the orientation of the passage 32 can be set to a desired direction so that the user may choose the direction of ejection of the pressurized air when using the power stapler 40.

The invention is not limited to the above embodiment but various modification thereof may be made. It will be understood by those skilled in the art that various changes in form and detail may made without departing from the scope and spirit of the present invention.

What is claimed:

1. A ventilation device of a power stapler, comprising:

an end base adapted to be connected to the rear end of the power stapler and said end base having a recess defined therein, a protrusion extending from a bottom defining said recess of said end base so as to define an annular recess between said protrusion and an inside of said recess of said end base, at least one aperture defined radially through said protrusion and a groove defined radially in a periphery of said protrusion, a boss extending from said protrusion, and a cover having a skirt portion and a passage defined radially through said skirt portion, a plurality of dents defined in an inside of said cover, said skirt portion engaged with said annular recess and said boss engaged on of said dents.

2. The ventilation device as claimed in claim 1 further comprising a hook portion extending radially inward from an inside of said skirt portion and said hook portion engaged with said groove of said protrusion.

* * * * *